US008016979B2

(12) United States Patent
Konuma

(10) Patent No.: US 8,016,979 B2
(45) Date of Patent: Sep. 13, 2011

(54) CHEMICAL SOLUTION-CONTAINING THIN PAPER

(75) Inventor: Atsushi Konuma, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 633 days.

(21) Appl. No.: 12/223,408

(22) PCT Filed: Jan. 12, 2007

(86) PCT No.: PCT/JP2007/050299

§ 371 (c)(1),
(2), (4) Date: Jul. 30, 2008

(87) PCT Pub. No.: WO2007/088717

PCT Pub. Date: Aug. 9, 2007

(65) Prior Publication Data

US 2009/0008052 A1 Jan. 8, 2009

(30) Foreign Application Priority Data

Jan. 31, 2006 (JP) ..... 2006-023928

(51) Int. Cl.

| | |
|---|---|
| ***D21H 19/00*** | (2006.01) |
| ***D21H 27/00*** | (2006.01) |
| ***A61K 8/02*** | (2006.01) |
| ***A61K 9/70*** | (2006.01) |

(52) U.S. Cl. ..... 162/135; 162/158; 162/175; 162/181.1; 162/181.6; 424/400; 424/402; 424/414; 428/320.2; 428/321.1; 428/321.5

(58) Field of Classification Search ..... 162/135, 162/158, 175, 181.1, 181.6; 106/4, 5, 14.05, 106/14.11, 14.21, 15.05; 424/69, 357, 400, 424/402, 414, 443, 484, 489; 428/320.2, 428/321.1, 321.5

See application file for complete search history.

(56) References Cited

U.S. PATENT DOCUMENTS

| | | | | |
|---|---|---|---|---|
| 4,800,076 | A * | 1/1989 | Bhat et al. | 424/69 |
| 6,713,414 | B1 * | 3/2004 | Pomplun et al. | 442/327 |
| 2004/0062791 | A1 * | 4/2004 | Branham et al. | 424/443 |
| 2006/0147505 | A1 * | 7/2006 | Tanzer et al. | 424/443 |

FOREIGN PATENT DOCUMENTS

| | | |
|---|---|---|
| JP | 2000-507656 | 6/2000 |
| JP | 2000-328486 | 11/2000 |
| JP | 2001-011790 | 1/2001 |
| JP | 2003-164386 | 6/2003 |
| JP | 3102807 | 4/2004 |
| JP | 2004-513961 | 5/2004 |
| JP | 2004-187970 | 7/2004 |
| JP | 2005-105479 | 4/2005 |

* cited by examiner

*Primary Examiner* — Eric Hug
*Assistant Examiner* — Peter Chin
(74) *Attorney, Agent, or Firm* — DLA Piper LLP (US)

(57) ABSTRACT

A chemical solution-containing thin paper wherein a chemical solution is contained in an amount of 5 to 40% by weight with respect to base paper, powders are included in an amount of 0.1 to 30% by weight with respect to the chemical solution, the powders are formed by blending first powders each having an average particle size of 3 to 15 μm and second powders each having an average particle size of 15 to 40 μm with a weight ratio of the first powders with respect to the second powders of 0.1:1.9 to 1.9:0.1, and the chemical solution does not include an adhesive ingredient.

2 Claims, No Drawings

CHEMICAL SOLUTION-CONTAINING THIN PAPER

TECHNICAL FIELD

The present invention relates to a thin paper containing a chemical solution including a moisture retention agent or the like.

BACKGROUND ART

Recently, there has been available in the market so called high-grade tissue paper which contains a chemical solution such as a moisture retention agent. Since this type of tissue paper has moist feeling and comfortable texture due to the contained chemical solution, when someone blow his or her nose repeatedly with such tissue paper, the nose is less likely to become sore and red, thus this type of tissue paper acquires populations (See, for example patent document 1 and patent document 2). This tissue paper is used not only for blowing a nose but also in making-up, for wiping a baby's mouth and so on. In such applications, low skin-irritant tissue paper is desired by a person having sensitive skin, a baby's family and the like. As for a texture to a touch, is desired also tissue paper which has a dry texture like a cosmetic sheet and which comfortably fits to skin.

In this type of a chemical solution-containing thin paper, there is proposed for improving a dry texture, some methods in each of which powders are added into a chemical solution (See patent document 3). By doing so, due to the added powders, frictions to skin can be decreased so that pliancy and moist feeling derived from a moisture retention agent are combined with a smoothness texture derived from the powders, thereby to impart a dry and smooth texture to a product.

However, in a conventional chemical solution-containing thin paper, there is still a problem where a dry texture and a smoothness texture cannot be obtained simultaneously as well as another problem where skin-irritancy cannot be decreased.

Patent document 1: Japanese Patent Application Laid-Open No. 2003-164326

Patent document 2: Japanese Patent Application Laid-Open No. 2004-513961

Patent document 3: Japanese Patent No. 3450230

DISCLOSURE OF THE INVENTION

Problem to be Solved by the Invention

Accordingly, a main object of the present invention is to provide a chemical solution-containing thin paper by which both of a dry texture and a smoothness texture can be obtained simultaneously and at the same time, skin-irritancy can be decreased.

Means for Solving the Problem

The present invention which has solved the above-described problem is as follows.

A chemical solution-containing thin paper wherein a chemical solution is contained in an amount of 5 to 40% by weight with respect to base paper, powders are included in an amount of 0.1 to 30% by weight with respect to the chemical solution, the powders are formed by blending first powders each having an average particle size of 3 to 15 μm and second powders each having an average particle size of 15 to 40 μm with a weight ratio of the first powders with respect to the second powders of 0.1:1.9 to 1.9:0.1, and the chemical solution does not include an adhesive ingredient.

(Operation)

In the chemical solution-containing thin paper, by using the first powders each having the relatively small particle size and the second powders each having the relatively large particle size with the predetermined weight ratio, a dry texture and a smoothness texture are improved thereby to decrease skin-irritancy. The powders each having the relatively small particle size contribute to the smoothness texture of the thin paper, but it is almost impossible to improve the dry texture by using only these small powders. On the other hand, the powders each having the relatively large particle size contribute to the dry texture of the thin paper, but a rough touch is caused by using only these small powders, resulting in discomfort for a user. In order to cope this, by combining these two kinds of powders, like the present invention, disadvantages of one kind of powders are cancelled by advantages of the other kind of powders mutually so that only the advantages are emerged as effects of the present invention, thereby both of the dry texture and the smoothness texture can be obtained simultaneously. In the present invention, the average particle size is average of particle sizes measured for all particles.

(Operation)

Further, in a chemical solution-containing thin paper, when a chemical solution includes powders, by the use of an adhesive ingredient, for fixing the powders to base paper, since the adhesive ingredient inhibits movements of the powders, when skin is brought into contact with the thin paper, there is a possibility that the powders ruin the skin. Additionally, the included adhesive ingredient makes the thin paper stiff thereby to increase skin-irritancy. On the contrary, in the thin paper according to the present invention where an adhesive ingredient is not included in the chemical solution, the powders are not fixed too strongly to the base paper and during the use of this thin paper, the added powders rotate or slide on the skin so that the skin-irritancy can be decreased.

The chemical solution-containing thin paper according to the present invention, the first powder is talc and the second powder is starch.

(Operation)

In the present invention, as the first powder, from the viewpoint of the range of its particle size and of improvement of the smoothness texture, talc is specifically preferable, while as the second powder, from the viewpoint of the range of its particle size and of improvement of the dry texture, starch is specifically preferable. The powder such as talc has plate crystals, thus these powders slide on skin during the use of the product thereby to impart the smoothness to a touch and decrease the skin-irritancy. The powder such as starch has particle crystals, thus these powders roll on the skin during the use of the product thereby to impart the dry feeling to a touch and decrease the skin-irritancy.

Effect of the Invention

As described above, by the present invention, both of the dry texture and the smoothness texture can be obtained simultaneously and at the same time the skin-irritancy can be decreased.

BEST MODE FOR CARRYING OUT THE INVENTION

Hereinafter, the embodiment of the present invention will be described.

As the base paper for the inventive thin paper, any known base paper can be used without limitation and specifically pulp fibers having NBKP content (according to JIS P 8120) of 30.0 to 80.0%, particularly 40.0 to 70.0% are preferably employed in the base paper. A basis weight (according to JIS P 8124) per 1-ply is preferably 10.0 to 35.0 g/m$^2$. A thickness (measured with PEACOCK gauge manufactured by OZAKI MFG CO., LTD.) of 2-ply paper (in duplicate) is preferably 100 to 300 μm and that of 1-ply paper is preferably the half of the above numerical value range. A crepe ratio (((circumferential speed of a dryer in paper making)−(circumferential speed of a reel))/(circumferential speed of a dryer in paper making)×100 is preferably 15.0 to 26.0.

The base paper of 2-ply used for the present invention has preferably a dry tensile strength (which can be sometimes referred as a dry paper strength) (according to JIS P 8113) of 130 cN/25 mm or more and specifically 280 to 310 cN/25 mm in a longitudinal direction and of 40 cN/25 mm or more and specifically 60 to 100 cN/25 mm in a lateral direction. The base paper of 1-ply has preferably the half of the above numerical ranges. In manufacturing the product from the base paper, too small dry paper strength of the base paper tends to cause a trouble such as tearing, elongating or the like. On the other hand, in using the product from the base paper, too large dry paper strength of the base paper causes stiffness to the touch.

Such numerical values for the paper strength can be adjusted by known methods, for example, by adding internally the paper strength agent (in a stage prior to a dryer part, e.g., into pulp slurry), by decreasing a freeness of the pulp (e.g. by about 30 to 40 ml), by increasing NBKP (e.g. to 50% or more) and so on. The above methods may be used in combination.

As a dry paper strength agent, CMC (carboxymethyl-cellulose) or the salt thereof such as sodium carboxymethylcellulose, carboxymethylcellulose calcium, carboxymethylcellulose zinc or the like can be used. As a wet paper strength agent, there can be used polyamide epichlorohydrin resin, urea resin, acid colloid melamine resin, thermal cross-linking PAM and the like. When the wet paper strength agent is added internally, it can be determined that the agent is added in amount of about 5 to 20 kg/t ratio by weight with respect to the pulp slurry. When CMC is added internally, it can be determined that the agent is added in amount of about 0.5 to 1.0 kg/t ratio by weight with respect to the pulp slurry.

In the present invention, the chemical solution is contained in the base paper. It is determined that the chemical solution is contained in amount of 5 to 40%, preferably 20 to 30% by weight with respect to the base paper. When the too small amount of the chemical solution is contained, the effects cannot be attained sufficiently and besides, the quantity of the chemical solution to be coated on the base paper becomes unstable. On the other hand, when the too large amount of the chemical solution is contained, the resultant thin paper becomes sticky, which inhibits the dry texture and the smoothness texture. As a process for containing the chemical solution, there can be used known procedures such as spray coating, roll coating and immersion and the like.

In the present invention, the chemical solution can be composed of about 60 to 100%, preferably about 80 to 95% by weight of an active ingredient and about 0 to 40%, preferably 5 to 20% by weight of an inactive ingredient such as water and the like.

Specifically, in the present invention, as the active ingredient, 0.1 to 30% by weight of powders is contained in the chemical solution. These powders are formed by blending the first powders each having the average particle size of 3 to 15 μm and the second powders each having the average particle size of 15 to 40 μm with the weight ratio of the first powders with respect to the second powders of 0.1:1.9 to 1.9:0.1. When the particle size of each of the first powders is too small, although the dry texture is improved, some of such powders are put into pores of the skin, which may cause skin problems. The size of each pore of the skin varies between individuals but is said to be about 2 to 5 μm. When the particle size of each of the powders is too small compared with that of the pore of the skin, some of such powders are accumulated in the pore, which causes skin roughness or acne. On the other hand, when the particle size of each of the powders is too large, the smoothness texture cannot be improved efficiently. On the surface of the thin paper, there are small grooves each having a depth of about 10 μm. The grooves, lumens formed between the pulp fibers are filled with the powders so that the roughness of the fibers is decreased thereby to improve the smoothness texture. When the particle size of each of the powders is too large, the powders cannot be put into the lumens formed between the pulp fibers, thus the smoothness texture cannot be improved. Further, when the particle size of each of the second powders is too small, the dry texture cannot be improved efficiently. Because, such second powders are accumulated in the grooves formed between the fibers so that they cannot easily rotate on the surface of the fibers. On the other hand, when the particle size of each of the second powders is too large, a coarse texture tends to be caused, even if the first powders are used together with the second powders. Because such second powders separate far from the surface of the sheet so as to elevate therefrom and as they rotate on the skin during the use of the sheet, a large pressure is applied to the skin, which imparts feeling of foreign substances to the skin. The particularly preferable range of average particle size of the first powder is 5 to 10 μm while that of the second powder is 20 to 30 μm.

As for the weight ratio of the first powders and the second powders on their blending, when the too large amount of the first powders and the too small amount of the second powders are blended, although the smoothness texture is improved, the dry texture is inhibited. On the other hand, when the too small amount of the first powders and the too large amount of the second powders are blended, although the dry texture is improved, the smoothness texture is inhibited. That is to say, when either the first powders or the second powders are too many or too little, the both of the dry texture and the smoothness texture cannot be obtained easily at the same time. It is particularly preferable that they are blended with a weight ratio of 0.5:1.5 to 1.5:0.5.

Additionally, when the too large amount of powders is contained in the chemical solution, fluidity of the chemical solution is decreased so that the chemical solution cannot be sufficiently permeable into the base paper and cannot be surely adhered to it. On the other hand, when the too small amount of powders is contained in the chemical solution, effects which would be obtained by the powders cannot be attained surely. It is particularly preferable that the powders are contained in amount of 5 to 20% by weight with respect to the chemical solution.

As the powder used for the present invention, there is an inorganic powder such as talc, kaolin, clay, calcium carbonate, titanium oxide and the like, a metal soap (aluminum stearate, magnesium stearate, calcium stearate, zinc stearate, lithium stearate and the like), an organic powder such as corn starch, wheat flour, rice starch, potato starch, wheat flour protein and the like. Any one of these powders can be used alone or a mixture of two or more may be used. It is possible that as the first powder and the second powder, the same substance is employed. It is also possible that as the first powder and the second powder, the different substances are employed. Particularly preferable combination is talc used for the first powder and starch used for the second powder.

According to a mechanism of the present invention, when the powders are contained in the chemical solution, the powders are transferred to the base paper together with lotion so that the lotion is adhered to the base paper and simultaneously the powders are adhered to the base paper too. In the present invention, the adhesive ingredient is not used in the chemical solution, because the adhesive ingredient makes the sheet hard and further inhibits the movement of the powders while the sheet is brought into contact with the skin. As the adhesive ingredient, there can be listed carboxymethylcellulose (CMC), polyvinyl alcohol (PVA), starch glue, urethane resin, latex and the like.

As another active ingredient, for example, a moisture retention agent can be included in the chemical solution. As the moisture retention agent, there can be listed polyalcohols such as glycerin, diglycerin, propylene glycol, 1,3-butylene glycol, polyethylene glycol and the like, sugars such as sorbitol, glucose, xylitol, maltose, maltitol, mannitol, trehalose and the like, a glucol based chemical and its derivatives, higher alcohols such as cetanol, stearyl alcohol, oleyl alcohol and the like, liquid paraffin, collagen, hydrolyzed collagen, hydrolyzed keratin, hydrolyzed silk, hyaluronic acid and its salts, ceramide and the like. Any one or any mixture of two or more of the above agents may be used. It is preferable that the moisture retention agent is contained in amount of 80 to 90%, particularly 80 to 85% by weight with respect to the active ingredients exclusive of the powders.

As other active ingredients, for example, an oily ingredient and an emulsifying ingredient can be contained in the chemical solution. It is preferable that the oily ingredient is contained in amount of 10 to 15%, particularly 10 to 12% by weight with respect to the active ingredients exclusive of the powders. It is preferable that the emulsifying ingredient is contained in amount of 0.5 to 2%, particularly 0.7 to 1.2% by weight with respect to the active ingredients exclusive of the powders. When the too large amount of the oily ingredients is contained in the chemical solution, a sticky texture is caused. When the too large amount of the emulsifying ingredients is contained in the chemical solution, the chemical solution can be formed easily. Thus, there may be raised problems where a texture is deteriorated and an operation capacity is lowered. On the other hand, when the too small amount of the oily ingredient and the too small amount of the emulsifying ingredient are contained in the chemical solution, an effect for maintaining a water content cannot be obtained sufficiently.

As the oily ingredient, there can be used an ingredient derived from petroleum or mineral oil such as vaseline and the like, an ingredient derived from animal oil such as mink oil, lanolin, squalane and the like, an ingredient derived from vegetable oil such as olive oil, jojoba oil, rosehip oil, almond oil, eucalyptus oil, avocado oil, camellia oil, soya bean oil, safflower oil, sesame oil, evening primrose oil, sunflower oil and the like and silicone oil such as alkyl methyl silicone and the like.

The emulsifying ingredient can be selected appropriately from an anionic surface-active agent, a nonionic surface-active agent, a cationic surface-active agent, and an amphoteric ion surface-active agent. The nonionic surface-active agent is preferable from the viewpoint of an antifoaming property and emulsion stability.

As the anionic surface-active agent, there can be used a carboxylate based agent, sulfonate based agent, salts of sulphate ester based agent, phosphate ester salt based agent and the like. Particularly, an alkyl phosphate ester salt is preferable.

As the nonionic surface-active agent, there can be used a mono fatty acid ester of polyol such as sorbitan fatty acid ester, diethylene glycol monostearate, diethylene glycol monooleate, glyceryl monostearate, glyceryl monoolete, propylene glycol monostearate and the like, N-(3-oleyloxy-2-hydroxypropyl) diethanolamine, polyoxyethylene hydrogenated castor oil, polyoxyethylene sorbitol beeswax, polyoxyethylene sorbitan sesquistearate, polyoxyethylene monooelate, polyoxyethylene monolaurate, polyoxyethylene cetylether, polyoxyethylene lauryl ether and the like.

As the cationic surface-active agent, there can be used a quaternary ammonium salt, amine salt, amine and the like.

As the amphoteric ion surface-active agent, there can be used a fatty derivative of secondary or tertiary amine containing carboxy, sulfonate or sulfate, fatty derivative of heterocyclic secondary or tertiary amine and the like.

Further, as other active ingredients, a softening agent, variety kinds of vitamin such as vitamin C, vitamin E and the like, amino-acid such as glycin, asparaginic acid, arginine, alanine, cystine, cysteine and the like, botanical extract such as an aloe yohjyu matsu ekisu, hydrangea serrata leaf extract, angelica keiskei extract, chaenomeles sinensis fruit extract, cucumber extract, equisetum arvense extract, solanum lycopersicum extract, rosa canina fruit extract, luffa cylindrica extract, lilium candidum bulb extract, astragalus sinicus extract and the like, kitosan, chitosan, urea, honey, royal jelly and the like.

The softening agent can be selected appropriately from an anionic surface-active agent, nonionic surface-active agent, cationic surface-active agent, and amphoteric ion surface-active agent. The anionic surface-active agent is particularly preferable. The concrete examples of the surface-active agents are the same as in the emulsifying agent. The softening agent is preferably contained in amount of 5 to 10%, particularly 5 to 8% by weight with respect to the active ingredient exclusive of the powders.

The other ingredients such as the variety kinds of vitamin, the botanical extracts and the like are preferably contained in amount of 0.000001 to 0.001% by weight with respect to the active ingredient exclusive of the powders.

Although for the thin paper according to the present invention, a producing method is not limited, it will be explained about when the chemical solution is supplied to the base paper. Here is an example of a marketable product type in which sheets of the thin paper are folded and laminated, such as a box packing type of tissue paper. In the first procedure, the chemical solution is supplied during a step where the base paper is conveyed in a folder for folding the base paper such as an inter folder or the like. In the second procedure, the chemical solution is supplied to the base paper and sheets of the chemical solution-containing paper are folded in the above folder. The first procedure is more preferable than the second procedure, because according to the first procedure, the thin paper can be produced more efficiently, the chemical solution is not vaporized so much and water is not evaporated so much either, resulting in the commercial products each having stable quality. There can be listed Japanese Patent Application No. 2004-251874 as an example of the second procedure.

EXAMPLES

Various kinds of 2-ply tissue paper shown in Table 1 (examples 1 to 4 according to the present invention and comparative examples 1 to 9) were produced for measuring and calculating some properties and performing sensory evaluations.

In these examples, the chemical solution exclusive the powders was comprised of 92% by weight of active ingredient and 8% by weight of water. The active ingredient was comprised of 83% by weight of moisture retention agent, 5% by weight of softening agent, 1% by weight of anti-oxidizing agent, 10% by weight of oily ingredient and 1.0% by weight of emulsifying agent.

The base paper had 19 g/m$^2$ of basis weight (1-ply), 50% of NBKP combination ratio, 50% of LBKP combination ratio, 650 ml of pulp freeness, 15 kg/t of added internally paper strength agent (with respect to the pulp slurry), 298 cN/25 mm of dry paper strength in a longitudinal direction, 70 cN/25 mm of dry paper strength in a lateral direction, 169 cN/25 mm of wet paper strength in a longitudinal direction and 50 cN/25 mm of wet paper strength in a lateral direction.

The properties were measured according to the JIS P 8111 with the exception of the water content. As for the sensory evaluation of the dry texture, an evaluation value was an average of marks assigned by 30 persons each felt the surface of the paper with his or her hand and rated its dry texture on a scale of 1 to 5 (5 marks; feel dry texture, 4 marks; feel somewhat dry texture, 3 marks; not feel dry texture so much, 2 marks; feel somewhat sticky texture and 1 mark; feel sticky texture). As for the sensory evaluation of the smoothness texture, an evaluation value was an average of marks assigned by 30 persons each felt the surface of the paper with his or her hand and rated its smoothness texture on a scale of 1 to 5 (5 marks; feel smoothness texture, 4 marks; feel somewhat smoothness texture, marks; not feel smoothness texture so much, 2 marks; feel somewhat coarse texture and 1 mark; feel coarse texture). As for the friction of the paper, mean deviation MMD was measured with "Friction Tester KESSE" (manufactured by KATO TECH CO., LTD). The larger the deviation MMD is, the smaller the smoothness is or the coarser the paper is. Softness was measured based on HANDLE-O-METER Method according to JIS L1096 E.

TABLE 1

| | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|---|---|---|---|
| chemical solution coated to base paper (%) | | 25 | 20 | 35 | 10 | 25 | 25 | 25 | 25 | 25 | 25 | 25 | 41 | 4 |
| lotion | | 20.0 | 16.0 | 30.0 | 9.0 | 20.0 | 20.0 | 12.5 | 19.0 | 18.75 | 18.75 | 18.75 | 38.6 | 3.6 |
| Talc (2 μm, plate) | | — | — | — | — | 5.0 | — | — | — | — | — | — | — | — |
| Talc (7 μm, plate) | | 2.5 | 2.0 | 1.5 | 0.5 | — | — | 6.0 | 2.5 | 0.1 | 6.15 | — | 1.2 | 0.2 |
| Talc (25 μm, plate) | | — | — | — | — | — | 2.5 | — | — | — | — | 1.25 | — | — |
| corn starch (2 μm, particle) | | — | — | — | — | — | — | — | — | — | — | 5.0 | — | — |
| corn starch (15 μm, particle) | | 2.5 | — | 3.5 | 0.5 | — | — | — | 2.5 | — | — | — | — | 0.2 |
| corn starch (28 μm, particle) | | — | 2.0 | — | — | — | 2.5 | — | — | 6.15 | 0.1 | — | 1.2 | — |
| corn starch (45 μm, particle) | | — | — | — | — | — | — | 6.5 | — | — | — | — | — | — |
| CMC (adhesive) | | — | — | — | — | — | — | — | 1.0 | — | — | — | — | — |
| general evaluation | | ◎ | ◎ | ○ | ○ | Δ | Δ | Δ | X | Δ | Δ | X | Δ | X |
| Sensory evaluation | Dry texture | 4.2 | 4.1 | 4.4 | 3.5 | 1.8 | 4.0 | 1.5 | 1.2 | 4.1 | 1.7 | 3.8 | 2.4 | 1.3 |
| | smoothness | 4.3 | 4.2 | 3.6 | 3.4 | 4.2 | 2.2 | 3.9 | 2.3 | 1.5 | 3.9 | 3.5 | 3.7 | 1.5 |
| quality | softness | 0.85 | 0.86 | 0.88 | 0.91 | 0.88 | 0.85 | 0.95 | 1.08 | 0.92 | 0.91 | 0.88 | 0.76 | 1.03 |
| test | MMD | 7.78 | 7.82 | 7.62 | 7.92 | 7.86 | 7.92 | 7.53 | 9.23 | 7.79 | 7.81 | 7.77 | 8.25 | 9.01 |

Referring to Table 1, results obtained from Examples 1 to 4 in accordance with the present invention direct that both of the dry texture and the smoothness can be obtained simultaneously and this is clearly different from the results from Comparative Examples 1 to 9.

INDUSTRIAL APPLICABILITY

The present invention can be applied to tissue paper, toilet paper, kitchen paper, crepe paper and the like.

The invention claimed is:

1. A chemical solution-containing thin paper wherein a chemical solution is contained in an amount of 5 to 40% by weight with respect to base paper, powders are included in an amount of 0.1 to 30% by weight with respect to the chemical solution, the powders are formed by blending first powders each having an average particle size of 3 to 15 μm and second powders each having an average particle size of 15 to 40 μm with a weight ratio of the first powders with respect to the second powders of 0.1:1.9 to 1.9:0.1, and the chemical solution does not include an adhesive ingredient.

2. The chemical solution-containing thin paper according to claim 1 wherein the first powder is talc and the second powder is starch.

* * * * *